US009269262B2

(12) United States Patent
Lee

(10) Patent No.: US 9,269,262 B2
(45) Date of Patent: Feb. 23, 2016

(54) APPARATUS AND METHOD FOR CONTROLLING TRAFFIC SIGNALS USING IDENTIFICATION INFORMATION HAVING HIERARCHICAL STRUCTURE

(75) Inventor: Heung Soo Lee, Seoul (KR)

(73) Assignee: Heung Soo Lee, Seoul (KR)

( * ) Notice: Subject to any disclaimer, the term of this patent is extended or adjusted under 35 U.S.C. 154(b) by 100 days.

(21) Appl. No.: 14/234,594

(22) PCT Filed: Jul. 2, 2012

(86) PCT No.: PCT/KR2012/005237

§ 371 (c)(1),
(2), (4) Date: Jan. 23, 2014

(87) PCT Pub. No.: WO2013/022188

PCT Pub. Date: Feb. 14, 2013

(65) Prior Publication Data

US 2014/0139358 A1 May 22, 2014

(30) Foreign Application Priority Data

Aug. 5, 2011 (KR) ..... 10-2011-0078038

(51) Int. Cl.
*G08G 1/095* (2006.01)
*G08G 1/07* (2006.01)
*G08G 1/09* (2006.01)

(52) U.S. Cl.
CPC . *G08G 1/07* (2013.01); *G08G 1/092* (2013.01)

(58) Field of Classification Search
CPC .... G08G 1/081; G08G 1/091; B60W 2550/22
USPC ..... 340/907, 909, 911, 924; 701/117
See application file for complete search history.

(56) References Cited

U.S. PATENT DOCUMENTS

| | | | | |
|---|---|---|---|---|
| 5,926,113 | A * | 7/1999 | Jones et al. | 340/906 |
| 7,515,064 | B2 * | 4/2009 | Schwartz | 340/902 |
| 8,884,783 | B2 * | 11/2014 | Roberts et al. | 340/906 |
| 2006/0197684 | A1 * | 9/2006 | Tremblay | 340/909 |
| 2013/0013179 | A1 * | 1/2013 | Lection et al. | 701/117 |

FOREIGN PATENT DOCUMENTS

| | | |
|---|---|---|
| KR | 1019990061409 | 7/1999 |
| KR | 1020010100275 | 11/2001 |
| KR | 1020060129993 | 12/2006 |
| KR | 1020090008964 | 1/2009 |

* cited by examiner

*Primary Examiner* — Phung Nguyen
(74) *Attorney, Agent, or Firm* — IP & T Group LLP

(57) ABSTRACT

Device and method of efficiently controlling a traffic light using identification information having a layered structure are provided. A traffic light control device that controls signal light change of a management-target traffic light includes: a broadcast signal receiving unit that receives a broadcast signal emitted from a traffic control center via a broadcast network, wherein the broadcast signal includes identification information having a layered structure and a control command; and a traffic light control unit that determines whether the management-target traffic light belongs to a target of the control command on the basis of the identification information having a layered structure and that outputs the control signal for performing the signal light change based on the control command only when the management-target traffic light belongs to the target of the control command.

16 Claims, 11 Drawing Sheets

| | | |
|---|---|---|
| LAYER 1 | CITY/PROVINCE | AREA ID |
| LAYER 2 | CITY/GUN/GU | |
| LAYER 3 | ROAD NAME | ROAD ORDINAL NUMBER |
| LAYER 4 | ROAD NUMBER | |
| LAYER 5 | TRAFFIC LIGHT NUMBER | TRAFFIC LIGHT ORDINAL NUMBER |

| STREET ADDRESS | SEOUL METROPOLITAN CITY | GEUMCHEON-GU | GEUMCHEON-RO | 594 | A |
|---|---|---|---|---|---|
| LAYER | 1 | 2 | 3 | 4 | 5 |

| LAYER | 1 | 2 | 3 | ... |
|---|---|---|---|---|
| WHOLE COUNTRY | 00 | | | |
| SEOUL | 01 | | | |
| GEUMCHEON-GU, SEOUL | 01 | 03 | | |
| GEUMCHEON-RO, GEUMCHEON-GU, SEOUL | 01 | 03 | 02 | |

| | 410 | 420 |
|---|---|---|
| WHOLE COUNTRY | 1 | 0000 |
| SEOUL | 1 | 0001 |
| GEUMCHEON-GU, SEOUL | 2 | 0010 |
| GEUMCHEON-RO, GEUMCHEON-GU, SEOUL | 3 | 0005 |

FIG. 9b

| 920 | 921 | 922 | 923 | 924 | 925 | 926 | | |
|---|---|---|---|---|---|---|---|---|
| DISTINCTION DATA | IDENTIFICATION INFORMATION | START TIME | CONTROLLER ID | TRAFFIC LIGHT NUMBER | SIGNAL LIGHT ORDER | FIRST SIGNAL LIGHT CYCLE | SECOND SIGNAL LIGHT CYCLE | ... |
| | | | | TRAFFIC LIGHT NUMBER | SIGNAL LIGHT ORDER | FIRST SIGNAL LIGHT CYCLE | SECOND SIGNAL LIGHT CYCLE | ... |
| | | | | TRAFFIC LIGHT NUMBER | SIGNAL LIGHT ORDER | FIRST SIGNAL LIGHT CYCLE | SECOND SIGNAL LIGHT CYCLE | ... |
| | | | CONTROLLER ID | TRAFFIC LIGHT NUMBER | SIGNAL LIGHT ORDER | FIRST SIGNAL LIGHT CYCLE | SECOND SIGNAL LIGHT CYCLE | ... |
| | | | ⋮ | ⋮ | ⋮ | ⋮ | ⋮ | ⋮ |

APPARATUS AND METHOD FOR CONTROLLING TRAFFIC SIGNALS USING IDENTIFICATION INFORMATION HAVING HIERARCHICAL STRUCTURE

This application is a national stage application of PCT/KR2012/005237 filed on Jul. 2, 2012, which claims priority of Korean patent application number 10-2011-0078038 filed on Aug. 5, 2011. The disclosure of each of the foregoing applications is incorporated herein by reference in its entirety.

TECHNICAL FIELD

The present invention relates to traffic light control device and method, and more particularly, to device and method of efficiently controlling a traffic light using identification information having a layered structure (a hierarchical structure).

BACKGROUND ART

Traffic lights are devices which are installed at crossroads or crosswalks on roads and which indicate stop, detour, passing, and the like to passing vehicles or pedestrians by flickering of red light, green light, yellow light, green arrow light, and the like.

With an exponential increase of vehicles, traffic congestion has become serious problems. The vehicle stop time due to traffic lights at downtown crossroads or crosswalks occupies a considerable ratio of the congestion rate due to various factors of roads. Therefore, it has been thought that the traffic congestion could be released by controlling signal light cycles of traffic lights at crossroads or crosswalks so as to improve a flow of vehicles, and various countermeasures have been proposed for this purpose.

Traffic light controllers are connected to a traffic control center via a network and change signal light in accordance with a control signal output from the traffic control center to adjust a flow of vehicles. In the related art, the traffic light controllers and the traffic control center are connected to each other via a wired network using exclusive lines. Since the traffic control center and the traffic light controllers communicate with each other in a one-to-one manner, the traffic control center needs a complicated system to transmit different control commands to all the traffic light controllers. In addition, since the traffic control center has to finish communications with all the traffic light controllers within a predetermined time, the system or the wired network using exclusive lines should be kept at a high speed and thus much cost such as facility cost, communication cost, facility maintenance cost, and network maintenance cost is consumed.

Therefore, in general, only the traffic light controllers controlling traffic lights installed in important road zones such as crossroads are connected to the traffic control center. In this case, in the traffic light controllers installed out of the important road zones such as crossroads, the cycle of a signal light changing operation is set to be constant and the signal light is changed with a predetermined cycle to adjust a flow of vehicles. That is, the traffic light controllers other than the traffic light controllers connected to the traffic control center operate without any interlock with the control of the traffic control center.

As described above, since only the traffic light controllers connected to the traffic control center via exclusive lines perform a signal light changing operation on traffic lights on the basis of traffic information based on traffic conditions to control a flow of vehicles and the other traffic light controllers perform the signal light changing operation with a predetermined signal light change cycle, there is a problem in that signal light of all the traffic lights cannot be controlled as a whole and thus a flow of vehicles cannot be smoothly controlled.

As a solution to this problem, Korean Patent Application Publication No. 10-2001-0100275 filed by the applicant of the present invention discloses traffic light control device and method of controlling a signal light changing operation by causing a traffic control center to selectively output a control signal for controlling traffic light controllers in a wireless manner. The applicant of the present invention has filed a lot of patent applications such as Korean Patent Application Publication No. 10-2006-0129993. However, in this case, different controls signals have to be generated and output to control a lot of traffic light controllers.

In the related art, Korean Patent Application Publication No. 10-2009-0008964 discloses a traffic light control device for smoothing a traffic flow in consideration of the number of vehicles by periodically counting passing vehicles, increasing a lighting time of a green light when the number of vehicles increases, and decreasing the lighting time of a green light when the number of vehicles decreases. In this case, a sensor unit for detecting a traveling vehicle and a counter unit for counting the number of vehicles need to be provided to each traffic light control device and the traffic lights are controlled independently of the control of the traffic control center. Accordingly, there is a problem in that the traffic lights may operate regardless of traffic flows of other roads.

Korean Patent Application Publication No. 10-1999-0061409 discloses a traffic-system link data constructing method of constructing link data using road names when roads having plural nodes and plural links have the road names including continuous links. It is intended to construct one N-bit link data piece having an additional link ID for a specific road, which is not regardless of traffic light control, and there is a problem in that the link data has a constant size of N bits.

SUMMARY OF THE INVENTION

Technical Problem

An object of the present invention is to provide traffic light control device and method which can simply and efficiently control traffic lights installed on roads using identification information having a layered structure.

Another object of the present invention is to provide traffic light control device and method which can give road link IDs and traffic light ID having a layered structure, select plural traffic lights by broadcasting a command at a time via a broadcast network, considerably reduce an amount of data to be transmitted for control, and simultaneously transmit commands and which does not need to connect plural traffic light controllers to a traffic control center in a one-to-one manner.

Still another object of the present invention is to provide traffic light control device and method which can cause plural traffic light controllers, which have a correlation and are grouped into a single group, to change traffic signal light on the basis of a vehicle traveling speed so that the traffic signal light with the same change cycle leads or lag by a predetermined offset with respect to a reference traffic light when a traffic control center broadcasts a command at a time via a broadcast network.

Other features of the present invention will be apparently understood from the following description.

Solution to Problem

According to an aspect of the present invention, there is provided a traffic light control device that controls signal light change of a management-target traffic light, including: a broadcast signal receiving unit that receives a broadcast signal emitted from a traffic control center via a broadcast network, wherein the broadcast signal includes identification information having a layered structure and a control command; and a traffic light control unit that determines whether the management-target traffic light belongs to a target of the control command on the basis of the identification information having a layered structure and that outputs the control signal for performing the signal light change based on the control command only when the management-target traffic light belongs to the target of the control command.

When an entire area taken charge of by the traffic control center is divided into sub areas corresponding to a plurality of exclusive layers in which traffic lights are installed, the identification information having a layered structure may be information for identifying one or more sub areas on which batch signal light change based on the control command will be performed. The identification information having a layered structure may have a structure in which a bit number of data increases with a shift to a lower layer. Layer information for distinguishing layers of sub areas which are the target of the control command may be extracted from the bit number of the identification information having a layered structure.

Alternatively, the identification information having a layered structure may include a layer code indicating the layer of a sub area which is the target of the control command and a detailed code for distinguishing the sub area from the other sub areas in the same layer.

Alternatively, the identification information having a layered structure may include a street code corresponding to a street address or a postal code corresponding to a lot number address.

The traffic light control unit may include: a broadcast signal analyzing unit that analyzes the broadcast signal; a time synchronizing unit that synchronizes a system time of the management-target traffic light with a system time of a reference traffic light using time-synchronization time data extracted from the broadcast signal or a GPS time estimated through the use of a GPS unit; an offset setting unit that sets an offset time using an offset parameter extracted from the broadcast signal; and a signal light change control unit that outputs a control signal for starting signal light display of the management-target traffic light at a time point which lags by the offset time from a signal light display start time point of the reference traffic light.

On the other hand, according to another aspect of the present invention, there are provided a traffic light control method which is performed by a traffic light control device that controls signal light change of a traffic light and a recording medium having recorded thereon a program for performing the traffic light control method.

The traffic light control method includes the steps of receiving a broadcast signal emitted from a traffic control center via a broadcast network, wherein the broadcast signal includes identification information having a layered structure and a control command; analyzing the broadcast signal and extracting layer information of the identification information having a layered structure; extracting distinction data corresponding to the layer information from the identification information of the management-target traffic signal; comparing the distinction data with the identification information of the broadcast signal and determining whether the management-target traffic light belongs to a target of the control command; and performing signal light change based on the control command when it is determined that the management-target traffic light belongs to the target of the control command.

When an entire area taken charge of by the traffic control center is divided into sub areas corresponding to a plurality of exclusive layers in which traffic lights are installed, the identification information having a layered structure may be information for identifying one or more sub areas on which batch signal light change based on the control command will be performed. The identification information having a layered structure may have a structure in which a bit number of data increases with a shift to a lower layer. The layer information for distinguishing layers of sub areas which are the target of the control command may be extracted from the bit number of the identification information having a layered structure. Upper bit data corresponding to the bit number corresponding to the layer information in the identification information of the management-target traffic light may be extracted from the distinction data.

Alternatively, the identification information having a layered structure may include a layer code indicating the layer of a sub area which is the target of the control command and a detailed code for distinguishing the sub area from the other sub areas in the same layer. An identification code having the same layer code as the layer code in the identification information of the management-target traffic light may be extracted as the distinction data.

Alternatively, the identification information having a layered structure may include a street code corresponding to a street address or a postal code corresponding to a lot number address.

The step of performing signal light change based on the control command may include the steps of determining an offset time from a reference traffic light on the basis of an analysis result of the broadcast signal; and outputting the control signal for controlling the signal light change of the management-target traffic light so that a time point which lags by the offset time from a reference time is matched with a signal light display start time point of the management-target traffic light.

Other aspects, features, and advantages of the present invention will become apparent from the accompanying drawings, the appended claims, and the detailed description of the invention.

Advantageous Effects

According to the aspects of the present invention, it is possible to simply and efficiently control traffic lights installed on roads using identification information having a layered structure.

In addition, it is possible to give road link IDs and traffic light ID having a layered structure, to select plural traffic lights with one broadcasting (a command) via a broadcast network, to considerably reduce an amount of data to be transmitted for control, and to simultaneously transmit commands and it is not necessary to connect plural traffic light controllers to a traffic control center in a one-to-one manner.

It is also possible to cause plural traffic light controllers, which have a correlation and are grouped into a single group, to change traffic signal light on the basis of a vehicle traveling speed so that the traffic signal light with the same change cycle leads or lags by a predetermined offset with respect to a reference traffic light when a traffic control center broadcasts a command at a time via a broadcast network.

It is also possible to considerably reduce an amount of data to be transmitted by enabling a command to be transmitted to plural traffic light controllers with one broadcasting via a broadcast network and to transmit a command to plural traffic light controllers by simultaneously transmitting the command to the plural traffic light controllers, and it is not necessary to connect plural traffic light controllers to a traffic control center in a one-to-one manner.

BRIEF DESCRIPTION OF THE DRAWING

FIG. 9*b* is a diagram illustrating an example of a format of signal light change control information according to the present invention.

DESCRIPTION OF EMBODIMENTS

The invention can be modified in various forms and specific embodiments will be described and shown below. However, the embodiments are not intended to limit the invention, but it should be understood that the invention includes all the modifications, equivalents, and replacements belonging to the concept and the technical scope of the invention. When it is determined that detailed description of known techniques involved in the invention makes the gist of the invention obscure, the detailed description thereof will not be made.

Terms such as "first" and "second" can be used to describe various elements, but the elements are not limited to the terms. The terms are used only to distinguish one element from another element.

The terms used in the following description are intended to merely describe specific embodiments, but not intended to limit the invention. An expression of the singular number includes an expression of the plural number, so long as it is clearly read differently. The terms such as "include" and "have" are intended to indicate that features, numbers, steps, operations, elements, components, or combinations thereof used in the following description exist and it should thus be understood that the possibility of existence or addition of one or more other different features, numbers, steps, operations, elements, components, or combinations thereof is not excluded.

In this specification, when it is mentioned that an element is "connected" to another element, it should be understood that both elements are "indirectly connected" with still another element interposed therebetween, as well as that both elements are "directly connected".

When it is determined that detailed description of known techniques involved in the invention unnecessarily makes the gist of the invention obscure, the detailed description thereof will not be made.

Hereinafter, embodiments of the invention will be described in detail with reference to the accompanying drawings.

Figure 1:
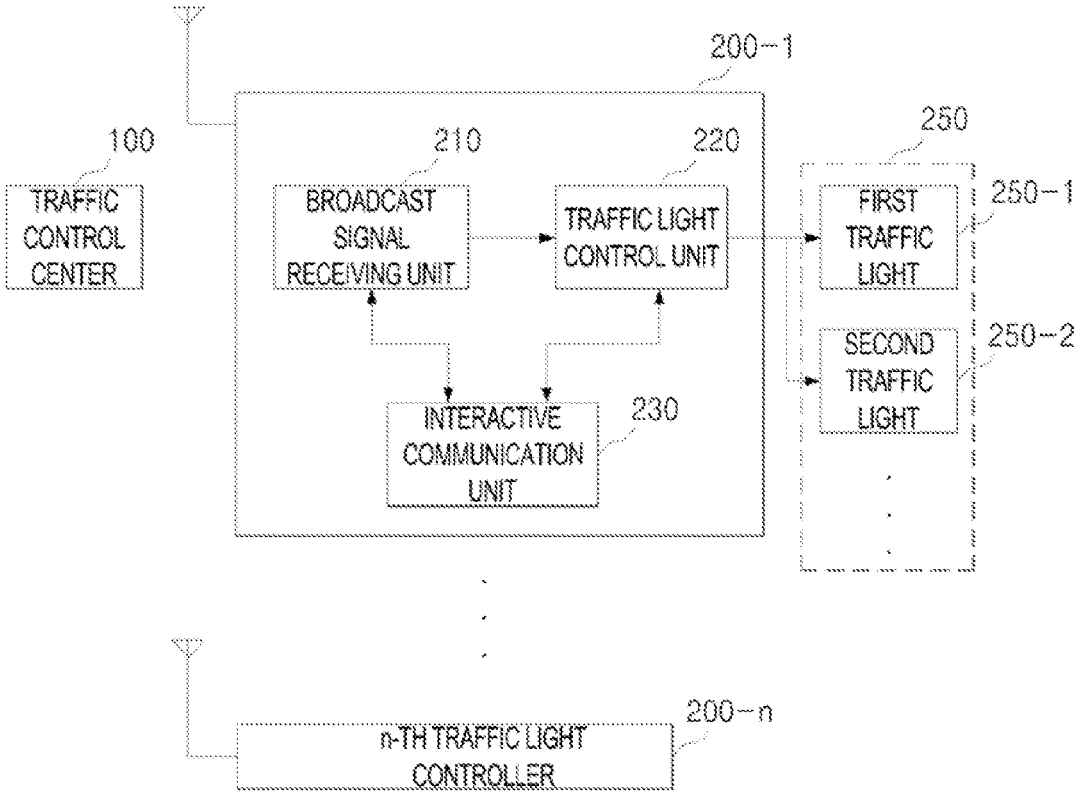
FIG. 1 is a block diagram illustrating a configuration of a traffic light control system according to an embodiment of the present invention.
Figures 2, 3A, 3B:
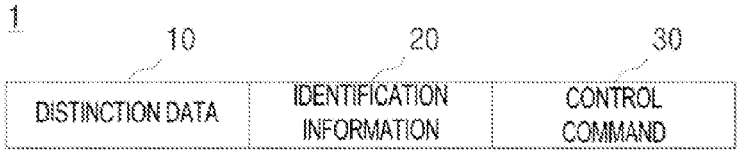
FIG. 2 is a diagram illustrating an example of a data format of a broadcast according to the present invention.
FIGS. 3*a* and 3*b* are diagrams illustrating a structure of layered identification information of a broadcast signal according to the present invention.
Figures 4A, 4B, 4C:
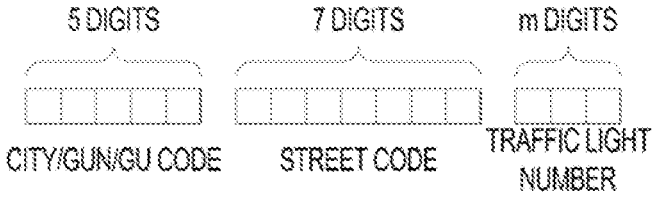
FIGS. 4*a* to 4*c* are diagrams illustrating examples of a data format of layered identification information of a broadcast signal according to the present invention.
Figure 5:
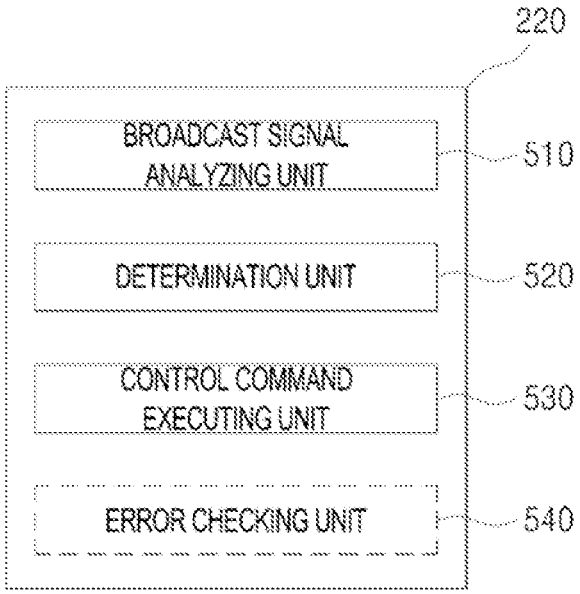
FIG. 5 is a block diagram illustrating a configuration of a traffic light control unit according to an embodiment of the present invention.

FIG. 1 is a block diagram illustrating a configuration of a traffic light control system according to an embodiment of the present invention. FIG. 2 is a diagram illustrating an example of a data format of a broadcast according to the present invention. FIG. 3 is a diagram illustrating a structure of layered identification information of a broadcast signal according to the present invention. FIGS. 4*a* to 4*c* are diagrams illustrating examples of a data format of layered identification information of a broadcast signal according to the present invention. FIG. 5 is a block diagram illustrating a configuration of a traffic light control unit according to the embodiment of the present invention.

A traffic light control system according to an embodiment of the present invention includes a traffic control center 100 and first to n-th traffic light controllers 200-1 to 200-*n* (which are generically referred to as "200"). One traffic light controller is connected to one or more traffic lights 250-1, 250-2, . . . and signal light change of the one or more traffic lights 250-1, 250-2, . . . is controlled by the corresponding traffic light controller. Here, each of the traffic lights 250-1, 250-2, . . . may be one of traffic lights for vehicles or pedestrians installed at crossroads or crosswalks. In the below description, the one or more traffic lights 250-1, 250-2, . . . are assumed to be one management-target traffic light.

In the traffic light control system according to an embodiment of the present invention, the traffic control center 100 broadcasts a broadcast signal including identification information (for example, a road link ID or a traffic light ID) having a layered structure to select traffic lights of which signal light change should be controlled and to transmit command to the selected traffic lights, and the traffic light controller receives the broadcast signal, analyzes the identification information included in the broadcast signal, and determines whether the traffic lights under management of the traffic light controller are included in a control target, controls the signal light change of the traffic lights in accordance with the command included in the broadcast signal when it is determined that the traffic lights are included in the control target. In this case, batch signal light change of traffic lights (for example, roads located in area A and traffic lights installed in the roads) of lower layers belonging to an upper layer (for example, area A) can be controlled with one broadcasting (a command).

The traffic control center 100 collects road information for controlling the signal light change of traffic lights. Examples of the road information to be collected include the current traveling speed of a vehicle traveling on a road, the number of lanes of the road, the gradient, the curvature, presence of a speed bump, a state of the road surface, the weather, the vehicle traffic, the queue, and the time zone. The collected road information is loaded into a broadcast signal without any change or with being processed or the offset times by traffic lights calculated on the basis of the collected road information are loaded into a broadcast signal, and the broadcast signal is broadcast via a broadcast network.

Such a broadcast signal is sent out at a time from the traffic control center 100 or from a base station, which is (not illustrated) connected to the traffic control center 100 via a wired or wireless network, by analog broadcast using data communication such as frequency modulation (FM) or amplitude modulation (AM) or data and command word communication such as digital multimedia broadcasting (DMB), digital audio broadcasting (DAB), digital video broadcasting-terrestrial (DVB-T), digital video broadcasting-handheld (DVB-H), and media forward link only (MFLO). Alternatively, the broadcast signal may be sent out at a time from a base station (not illustrated), which is connected to the traffic control center 100 via a wired or wireless network, via a mobile communication network such as CDMA, WCDMA, and LTE (Long Term Evolution) or a short-range radio communication network such as WIFI. That is, the broadcast signal may be sent out by base stations.

Referring to FIG. 2, a broad cast signal 1 sent out from the traffic control center 100 or a broadcast station or a base station connected thereto includes distinction data 10, identification information 20 having a layered structure, and a control command 30.

The distinction data 10 is data for distinguishing the type of the broadcast and indicates one of control of a display start time point, signal light control, update of a display table, and combinations thereof depending on the attributes of the control command 30.

The identification information 20 having a layered structure is information for identifying a traffic light to be subjected to traffic light control operation such as the control of a display start time point, the signal light change, and the update of a display table in accordance with the control command 30 and indicates a minimum area range to which the traffic lights to be controlled in batch. For example, when the identification information 20 indicates the "whole country", all traffic lights installed in the whole country are control targets. When the identification information indicates "Geumcheon-gu, Seoul", all traffic lights installed in Geumcheon-gu of Seoul are control targets. When the identification information indicates "594 Geumcheon-ro, Geumcheon-gu, Seoul", all traffic lights installed in 594 Geumcheon-ro of Geumcheon-gu of Seoul are control targets.

Such identification information 20 has a layered structure for distinguishing roads and areas in which traffic lights are installed. The identification information 20 having a layered structure may have a code corresponding to each area (sub area) obtained by dividing the entire area (for example, the whole country) taken charge of by the traffic control center 100 into plural layers. The areas divided into plural layers may be distinguished, for example, on the basis of lot number addresses based on administrative districts which are administration units into which the national area is divided for the administrative purpose, or postal codes based on street addresses to be newly enforced, or street codes. In the following description, it is assumed that the identification information having a layered structure is based on street addresses to be newly enforced, but the scope of the present invention is not limited to the assumption. Various cases in which identification information has a divisional structure including plural layers are included in the scope of the present invention.

Each zone divided into plural layers in the present invention has a structure in which a classification in which an upper-layer area includes one or more lower-layer areas and a lower-layer area is included in only one upper-layer area is repeated. For example, when the traffic control center 100 takes charge of the whole country as illustrated in (a) of FIG. 3, the entire country may be divided so that an area ID indicating city (metropolitan city)/province and city/gun/gu is an upper layer (layers 1 and 2) and a road ordinal number indicating a road name and a road number is a lower layer (layers 3 and 4). Here, traffic light numbers (for example, traffic light ordinal number) for identifying traffic lights installed in the corresponding road may be further included as layer 5 in the lowermost layer of the identification information.

For example, as illustrated in (b) of FIG. 3, "594 Geumcheon-ro, Geumcheon-gu, Seoul" which is an address indicating a street in which traffic light A is installed may be converted into identification information having a layered structure in which the address is divided into Seoul Metropolitan city (layer 1), Geumcheon-gu (layer 2), Geumcheon-ro (layer 3), and 594 (layer 4) and traffic light number A (layer 5) is further included as the lowermost layer.

Various examples of the identification information having a layered structure included in a broadcast signal are illustrated in FIGS. 4*a* to 4*c*.

Referring to FIG. 4*a*, N (which is a natural number) bits are allocated to each layer and the entire code length of the identification information increases with an increase in the number of layers. Here, it is assumed that the same bit number is allocated to each layer, but the bit number of each layer may be appropriately changed such as allocating the larger bit number to the lower layer than an upper layer.

For example, when it is assumed that 2 bits are allocated to each layer, identification information of layer 1 such as "whole country" or "Seoul Metropolitan city" may be 2-bit data such as "00" or "01". The identification information of layer 2 such as "Geumcheon-gu, Seoul" may be 4-bit data such as "0103", and the identification information of layer 3 such as "Geumcheon-ro, Geumcheon-gu, Seoul" may be 6-bit data such as "010302". In this case, layer information may be acquired from the data length (bit number) of the identification information.

Referring to FIG. 4*b*, the identification information includes a layer code 410 and a detailed code 420. The layer code 410 represents the lowermost layer of an area indicated by the identification information, and the detailed code 420 represents a value for distinguishing the corresponding area in the lowermost layer.

For example, the layer code 410 of layer 1 such as "whole country" and "Seoul Metropolitan city" is the same as "1" and the detailed codes 420 thereof are "0000" and "0001" and are distinguished from each other. The layer code 410 of layer 2 such as "Geumcheon-gu, Seoul" may be "2" and the detailed code 420 thereof may be "0010". The layer code 410 of layer 3 such as "Geumcheon-ro, Geumcheon-gu, Seoul" may be "3" and the detailed code 420 thereof may be "0005". The detailed codes of different layers may have the same value. In this case, layer information can be acquired from the layer code 410 of the identification information.

Referring to FIG. 4*c*, the identification information may employ a street code determined using a street address system which is currently enforced. The street code includes a city/gun/gu code of 5 digits and a street number of 7 digits. A traffic light number (of m digits, where m is a natural number) may be added to the street code, which may be used as the identification information. H-ere, the relationship between the street code and the street address may be based on the criterion provided by the Ministry of Security and Public Administration.

In addition, identification information having a layered structure can created using various methods such as defining layers on the basis of the scale of a map and using a map number as the identification information or using a postal code as the identification information, and can be used as information for identifying traffic lights.

Referring to FIG. 2 again, a control command 30 included in a broadcast signal includes information for controlling a display start time point, information for controlling signal light, and information for updating a display table, which will be described in detail later with reference to the relevant drawings.

In this embodiment, when the same control command is given for plural identification information pieces, the broadcast signal can be constructed in the following structure.

```
<traffic>
<time>time1</time>
<id>id1-id2</id><act>act</act>
...
</traffic>
```

Here, <traffic> and </traffic> represent distinction data indicating a broadcast signal related to traffic light control, <id> and </id> represent identification information of a layered structure, and <act> and </act> represent a control command.

Alternatively, when different control commands are given for plural identification information pieces, the broadcast signal may be constructed in the following structure.

```
<traffic>
<time>time1</time>
<id>id1-id2</id><act>act1-act2</act>
...
</traffic>
```

Alternatively, when the same control command and different control commands are mixed for plural identification information pieces, the broadcast signal may be constructed in the following structure.

```
<traffic>
<time>time1</time>
<id>id1,id2,id3,id4,...</id><act>act1,act1,act2,act3...</act>
...
</traffic>
```

In this embodiment, by using the identification information having a layered structure, it is possible to transmit a control command to all the traffic lights installed in a predetermined area with one broadcasting of a broadcast signal. As a result, since an amount of data to be transmitted can be minimized, it is possible to reduce network facility cost and maintenance cost in comparison with an existing traffic light control facilities, to minimize a network load, and to simplify the structure and the command system of a traffic light controller.

Referring to FIG. 1 again, the traffic control center 100 may receive state information of controllers and traffic lights transmitted from the traffic light controller 200. The state information of controllers and traffic lights may include information on abnormal states of the controllers, a broadcast signal reception error, a traffic light operation error, and the like.

The first traffic light controller 200 includes a broadcast signal receiving unit 210 and a traffic light control unit 220. In some embodiments, the first traffic light controller may further include an interactive communication unit 230. The other traffic light controllers have the same configuration as the first traffic light controller 200. Description will be made below centered on the first traffic light controller 200.

The traffic light controllers 200 are installed to correspond to management-target traffic lights (including a reference traffic light which is not virtual), respectively, and manage the corresponding management-target traffic lights. Each traffic light controller 200 may be disposed in a housing installed on the outer wall of a traffic light or a separate housing disposed around the traffic light with devices or instruments corresponding to the constituent units mounted thereon.

In some embodiments, two or more traffic light controllers 200 may be provided to one management-target traffic light. For example, in a crossroad, since four traffic lights for vehicles and four traffic lights for pedestrians should be controlled and the positions of the traffic lights are physically spaced apart, the plural traffic lights may be grouped into two or more groups and may be individually controlled by plural traffic light controllers 200, for the purpose of convenience of the signal light change control and facilitation of installation. In this case, two or more traffic light controllers 200 managing one management-target traffic light may have the same identifier.

The broadcast signal receiving unit 210 receives a broadcast signal sent out from the traffic control center 100. The broadcast signal sent out from the traffic control center 100 is broadcast as a data broadcast signal such as FM, AM, DMB, DAB, DVB-T, DVB-H, and MFLO via a predetermined broadcast channel, and the broadcast signal receiving unit 210 may be one of an FM receiver, an AM receiver, a DMB receiver, a DAB receiver, a DVB-T receiver, a DVB-H receiver, and an MFLO receiver for receiving such data broadcast signal via the corresponding broadcast channel.

The traffic light control unit 220 controls the signal light change of management-target traffic lights 250 managed by the traffic light controller 200. For this purpose, the traffic light control unit 220 determines whether the management-target traffic lights 250 belong to a control target on the basis of the layered identification information included in the broadcast signal, and controls the signal light change of the management-target traffic lights 250 in accordance with a control command included in the broadcast signal only when the management-target traffic lights 250 belong to the control target. Here, the management-target traffic lights 250 include traffic lights for vehicles and/or traffic lights for pedestrians which are installed at a crossroad or a crosswalk and of which the signal light change is performed by interlocking with each other.

The traffic light control unit 220 will be described below in detail with reference to FIG. 5.

Referring to FIG. 5, the traffic light control unit 220 includes a broadcast signal analyzing unit 510, a determination unit 520, and a control command executing unit 530. In some embodiments, the traffic light control unit may further include an error checking unit 540. One or more elements of the traffic light control unit may be embodied in the form of one or more of an algorithm implemented by a combination of program codes and a software program.

The broadcast signal analyzing unit 510 analyzes the broadcast signal received by the broadcast signal receiving unit 210 and extracts distinction data, identification information, a control command, and the like from the broadcast signal. The format of the broadcast signal is the same as described with reference to FIG. 2. When the broadcast signal is encoded in a predetermined data format (for example, TPEG format), the broadcast signal analyzing unit 510 may include a decoder (not illustrated) that can decode such a data format.

The determination unit 520 determines whether a management-target traffic light 250 belongs to a target of a control command on the basis of the identification information having a layered structure extracted from the broadcast signal.

Layer information is extracted from the identification information, and distinction data corresponding to the layer information is extracted from identification codes of the management-target traffic lights stored in advance in a memory (not illustrated). The extracted identification information (or a part thereof) is compared with the extracted distinction data, it is determined that the management-target traffic light belongs to the target of the control command when both are equal to each other and it is determined that the management-target traffic light 250 does not belong to the target of the control command when both are not equal to each other.

Only when the management-target traffic light 250 belongs to the target of the control command, the control command executing unit 530 executes the control command included in the broadcast signal to cause the management-target traffic light 250 to perform predetermined operations (such as adjusting a display start time point, changing signal light, and updating a display table).

In another embodiment, the traffic light control unit 220 may further include an error checking unit 540. The error checking unit 540 stores error information such as a traffic light error, a GPS error, and a broadcast signal reception error as history data and transmits the history data to the traffic control center 100 immediately or in accordance with a constant schedule on the basis of a predetermined criterion (for example, seriousness of the error). The transmission of the history data from the error checking unit 540 can be carried out via an interactive communication unit 230 to be described later.

Examples of the traffic light error include a case where failure such as short-circuit or disconnection due to current flowing in the circuits is detected when the traffic light is turned on or turned off. Examples of the GPS error include a case where the GPS data is not received or the GPS time is not changed at the time of checking the GPS signal or a case where the GPS time is not changed or the GPS data is not received even in a predetermined time after the GPS unit is reset. Examples of the broadcast signal reception error include a case where a broadcast signal is not received, or a received data packet includes an error, counter data for checking an error included in the data is not updated for a predetermined time, or the counter value is not increased.

The type (for example, one or more of the traffic light, the GPS unit, and the broadcast signal receiving unit) of a module having an error, the error occurrence time, and the number of error occurrence along with the identifier of the traffic light controller having an error may be included in the history data and may be transmitted together.

Referring to FIG. 1 again, the traffic light controller 200 according to another embodiment may further include an interactive communication unit 230 that transmits the error information generated from the error checking unit 540, that is, information indicating the internal abnormal state of the controller and/or the abnormal state of the traffic light to the traffic control center 100.

The interactive communication unit 230 may use a wired or wireless network and may be a communication module that can transmit and receive data via the third-generation, fourth-generation, or next-generation mobile communication network such as CDMA, WCDMA, GSM, and LTE or that can transmit and receive data via a short-range radio communication network such as WIFI.

When the traffic control center 100 requests the traffic light controller 200 for interactive communication, the interactive communication unit 230 can perform interactive communication with the traffic control center 100 so as to exchange data and programs or the like.

In an existing Internet network using fixed IP addresses, the traffic light controller can respond to a request from the traffic control center 100, but cannot transmit a response without any request. However, in the present invention, when the traffic control center 100 requests communication with a traffic light controller 200 having a specific ID via a broadcast network, the traffic light controller 200 having the ID can be provided with a variable IP address through the use of the interactive communication unit 230 and can access the traffic control center 100.

Figure 6:
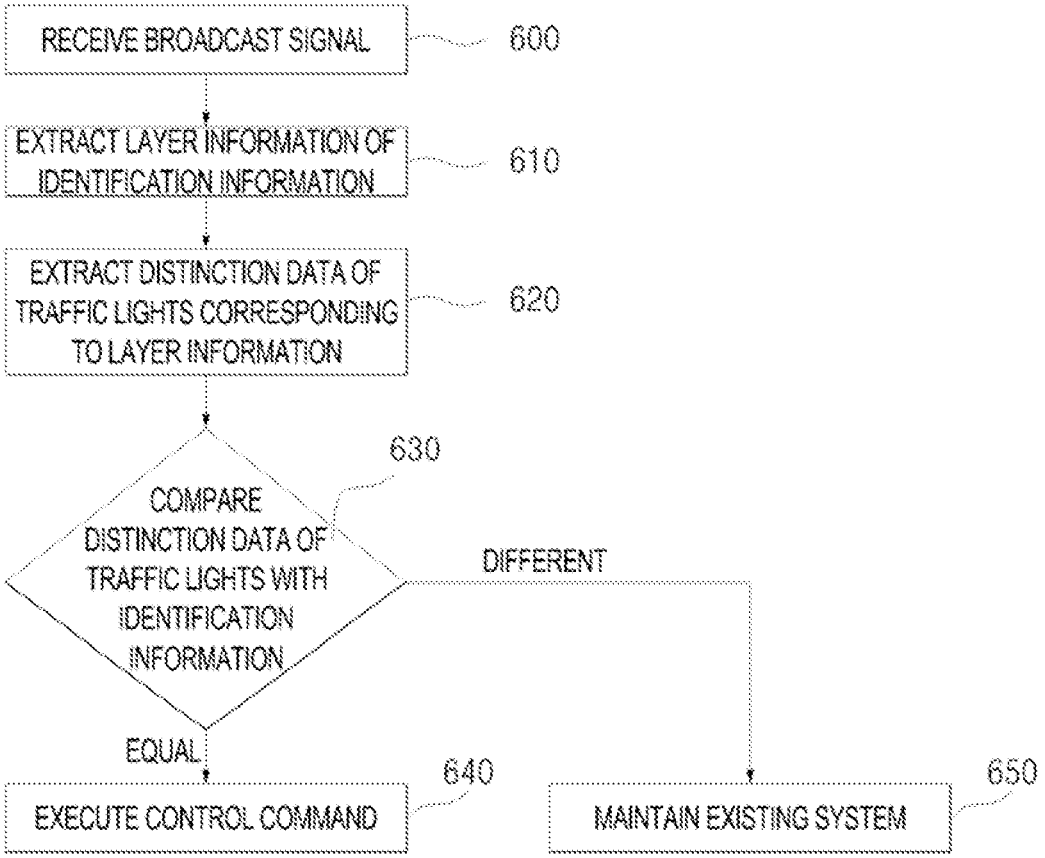
FIG. 6 is a flowchart illustrating a traffic light control method according to an embodiment of the present invention.
Figure 7A:
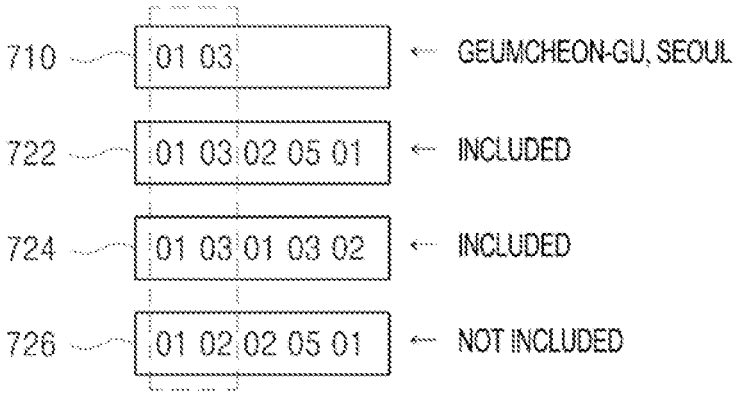
FIGS. 7*a* and 7*b* are diagrams illustrating an example of a determination step according to the present invention.
Figure 7B:
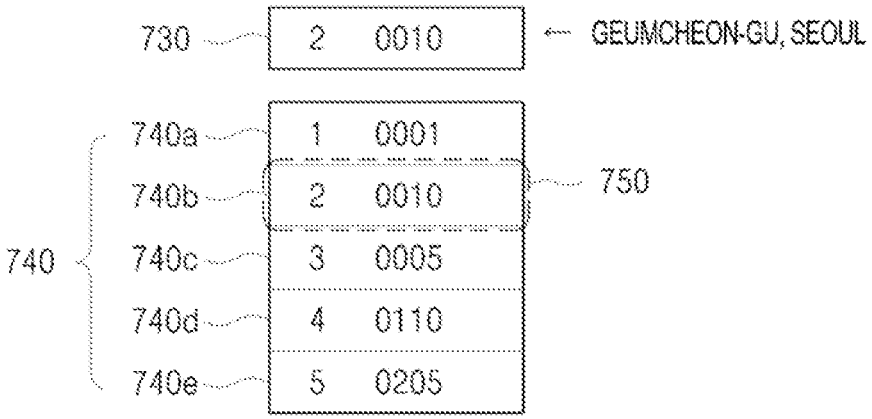

FIG. 6 is a flowchart illustrating a traffic light control method according to an embodiment of the present invention. FIG. 7 is a diagram illustrating examples of a determination process according to the present invention.

The process flow illustrated in FIG. 6 is performed by the constituent units of the traffic light controller and is based on a method of controlling signal light change of management-target traffic lights only when it is determined that the management-target traffic lights belong to a target of a control command on the basis of the identification information having a layered structure included in a broadcast signal received via a broadcast network.

Referring to FIG. 6, the broadcast signal receiving unit 210 receives a broadcast signal emitted from the traffic control center 100 or a broadcast station (or base station) connected thereto via the broadcast network in step 600. The broadcast signal may be received via a broadcast channel such as FM, AM, DMB, DAB, DVB-T, DVB-H, and MFLO.

In step 610, the broadcast signal analyzing unit 510 analyzes the broadcast signal received by the broadcast signal receiving unit 210 and extracts layer information in the identification information having a layered structure. The layer information in the identification information having a layered structure is value indicating an area range to be controlled using the broadcast signal as illustrated in FIGS. 4*a* and 4*b*.

For example, when the data length increases with an increase in the number of layers as illustrated in FIG. 4*a*, the layer information can be extracted from the data length. Alternatively, data may be present of which the data length increases with an increase in layer code and detailed code as illustrated in FIG. 4*b*.

In step 620, the determination unit 520 extracts distinction data corresponding to the layer information extracted for management-target traffic lights. The identification information of the management-target traffic lights are stored in advance in a memory, and only parts of the identification information corresponding to the layer information are extracted as the distinction data.

For example, the identification information having the data format illustrated in FIG. 4*a* is illustrated in (a) of FIG. 7. When the identification information 710 of the broadcast signal is "0103" which indicates "Geumcheon-gu, Seoul", it means that the broadcast signal includes a control command for all the traffic lights installed in Geumcheon-gu, Seoul. In this case, the identification information of the management-target traffic lights may be 10-bit data indicating values of layers 1 to 5, and for example, the identification information of three management-target traffic lights are illustrated as reference numbers 722, 724, and 726.

At this time, since the layer information in the identification information extracted in step 610 indicates layer 2 (city/gun/gu layer), only the bit data (upper 4-bit data) corresponding to the layer information is extracted as the distinction data from the identification information for the management-target traffic lights. That is, "0103" is extracted as the distinction data from the identification information 722 and 724 of the first and second management-target traffic lights, "0102" is extracted as the distinction data from the identification information 726 of the third management-target traffic light, and this data is compared with the identification information of the broadcast signal in step 630. Since the distinction data of the first and second management-target traffic lights is the same as the identification information of the broadcast signal, the first and second management-target traffic lights are determined to be traffic lights installed in Geumcheon-gu, Seoul and are subjected to the signal light change control based on the control command included in the broadcast signal. On the contrary, since the distinction data of the third management-target traffic light is not the same as the identification information of the broadcast signal, the third management-target traffic light is determined to be a traffic light installed in an area other than Geumcheon-gu. Seoul and is maintained in an existing signal light change system.

For example, a case where the identification information has the data format illustrated in FIG. 4*b* is illustrated in (b) of FIG. 7. When the identification information 730 of the broadcast signal is "2 0010" and indicates "Geumcheon-gu, Seoul" of layer 2 (city/gun/gu layer), it means that the broadcast signal includes a control command for all traffic lights installed in Geumcheon-gu, Seoul. In this case, the identification information 740 of the management-target traffic lights has detailed codes 740*a* to 740*e* corresponding to layer codes of layers 1 to 5. At this time, since the identification information extracted in step 610 is "Geumcheon-gu, Seoul" and the layer information thereof indicates layer 2, only the bit data (detailed codes (which may include layer codes if necessary)) corresponding to the layer information is extracted as the distinction data 750. That is, "2 0010" which is the identification code of layer 2 is extracted from the identification information 740 of the management-target traffic lights and this data is compared with the identification information of the broadcast signal in step 630.

For example, when it is assumed that the identification information of a broadcast signal includes a layer code (level) and a detailed code (no), the broadcast signal may be constructed in the following XML format.

(1) Batch control on all over Geumcheon-gu, Seoul

<id level="2" no="02"></id>

(2) Batch control on only Siheung 1-dong (detailed code 4) in Geumcheon-gu

<id level="2" no="02">4</id>

(3) Batch control on Gasan-dang, Doksan 1-dong, Doksan 2-dong, Siheung 1-dong, and Siheung 2-dong (detailed codes 1 to 5) in Geumcheon-gu <id level="2" no="02">1,2,3,4,5</id>

(4) Batch control on dongs other than Gasan-dong (detailed code 1) in Geumcheon-gu <id level="2" no="02">−1</id>

(5) Batch control on dongs other than Gasan-dong. Doksan 1-dong, Doksan 2-dong, Siheung 1-dong, and Siheung 2-dong (detailed codes 1 to 5) in Geumcheon-gu <id level="2" no="02">−1,−2,−3,−4,−5</id>

In step 630, the determination unit 520 compares the distinction data of the management-target traffic light extracted in step 620 with the identification information extracted from the broadcast signal, and determines whether the management-target traffic light belongs to the target of the control command included in the broadcast signal. The determination unit determines that the management-target traffic light belongs to the target of the control command included in the broadcast signal when the identification information is matched with the distinction data, and determines that the management-target traffic light does not belong to the target of the control command when both are not matched with each other.

When it is determined that the management-target traffic light belongs to the target of the control command included in the broadcast signal, the traffic light control unit 220 performs traffic light control based on the control command included in the broadcast signal in step 640. When it is determined that the management-target traffic light does not belong to the target of the control command included in the broadcast signal, the traffic light control unit 220 maintains the existing signal light change system regardless of the control command included in the broadcast signal in step 650.

In this embodiment, the traffic light controller 200 analyzes the identification information having a layered structure included in the broadcast signal, determines whether the management-target traffic light belongs to the target of the control command, and executes the control command only when the determination result is positive.

Accordingly, even when a control command is issued to plural traffic lights over a broad area in a batch manner, the control command can be issued with one time of broadcasting a control command. As a result, it is possible to considerably reduce an amount of data to be transmitted and to cause the traffic control center to efficiently perform traffic light control within a short time in a centralized manner.

The above-mentioned traffic light control method may be embodied as automated procedures based on the time-series order by a program built or installed in a digital processor. Codes and code segments of the program will be easily inferred by computer programmers skilled in the art. The program can be stored in a computer-readable recording medium and can be read and executed by a digital processor to embody the above-mentioned method. The recording medium includes a magnetic recording medium, an optical recording medium, and a carrier wave medium.

In the present invention, by issuing a control command related to signal light change to the traffic lights selected at a time by the identification information having a layered structure, comprehensive control can be performed using an offset time based on a distance between the traffic lights.

Figure 8:
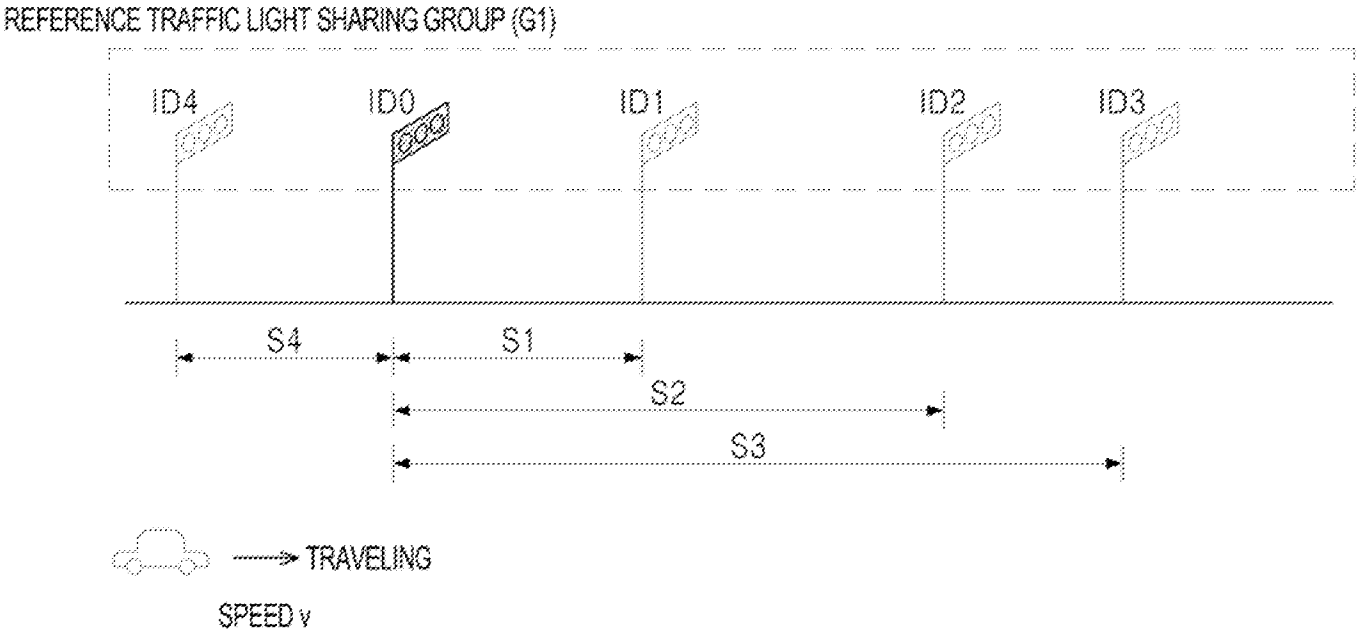
FIG. 8 is a diagram illustrating a concept of a traffic light control method according to an embodiment of the present invention.

FIG. 8 is a diagram illustrating the concept of the traffic light control method according to the embodiment of the present invention. As illustrated in FIG. 8, it is assumed that traffic lights ID0 to ID4 are installed at crossroads and/or crosswalks with a constant gap or arbitrary gaps on roads selected by the identification information having a layered structure.

When the traffic lights ID0 to ID4 are sequentially changed to green light which indicates that vehicles can pass to correspond to the traveling speed of the vehicles, that is, when vehicles at a reference traffic light ID0 moves and a next traffic light operates to display signal light indicating that vehicles can pass at the time of reaching the next traffic light, it will be possible to shorten the wait time at traffic lights of the crossroads or crosswalks, to improve a traffic low, and to reduce traffic congestion. Accordingly, it is necessary to cause the traffic lights to operate so that a corresponding traffic light indicates passing signal light when a vehicle at the reference traffic light ID0 moves and reaches the corresponding traffic light by causing the traffic lights to change signal light depending on the traveling speed of the vehicle.

In the present invention, a road section selected in a batch manner by the identification information having a layered structure may include a set of one or more road links. The road link means a road between two adjacent junctions (for example, intersections or interchanges).

Traffic lights ID0 to ID4 which are installed in one or more road links of the road section selected in a batch manner are grouped into a reference traffic light sharing group G1 in which a single reference traffic light is shared.

The traffic lights ID0 to ID4 belonging to the reference traffic light sharing group G1 share a traffic light as a reference traffic light and determine a signal light display start time point at which signal light change of the traffic lights is started by interlocking with the signal light display start time point of the reference traffic light. Here, the reference traffic light may be a traffic light which is really installed, but may be a virtual traffic light which is not really installed in some cases.

In the below description, it is assumed that the reference traffic light is ID0 and management-target traffic lights are ID1 to ID4 as illustrated in FIG. 1. The reference traffic light ID0 which is not a virtual traffic light may also be a management-target traffic light of which the offset time to be described later is 0 (zero).

The management-target traffic lights are installed at crossroads or crosswalks of a road section and include traffic lights for vehicles and traffic lights for pedestrians of which the signal light change is carried out by interlocking with each other. For example, in case of a crossroad, four-direction traffic lights installed at the crossroad and four pairs of traffic lights for pedestrians used to cross the roads are included in the management-target traffic lights. In case of a crosswalk, a bidirectional traffic light and a pair of traffic lights for pedestrians are included in the management-target traffic lights.

By setting the signal light display start time point of the reference traffic light ID0 as a reference start time and causing the signal light display start time points of the management-target traffic lights ID1 to ID4 to lead or lag with respect to the reference start time by offset times derived from the correlation between the distance between the reference traffic light ID0 and the management-target traffic lights ID1 to ID4 and the traveling speed of vehicles, the corresponding management-target traffic light is changed to green light at the time point at which a vehicle passing through the reference traffic light ID0 reaches the corresponding management-target traffic light, and thus the vehicle can continue to pass without stopping, thereby making the traffic flow smooth.

When it is assumed that the signal light display start time point of the reference traffic light ID0 is 00:00, the offset time of the first management-target traffic light ID1 is derived as S1/v on the basis of the correlation between the traveling speed v of a vehicle and the distance from the reference traffic light ID0 and the signal light display start time point thereof is set to the time point which lags by S1/v from 00:00. The offset times of the second and third management-target traffic lights ID2 and ID3 are derived as S2/v and S3/v on the basis of the correlation between the traveling speed v of a vehicle and the distances S2 and S3 from the reference traffic light ID0 and the signal light display start time points thereof are set to the time points which lag by S2/v and S3/v from 00:00. Regarding the fourth management-target traffic light ID4, since the distance from the reference traffic light ID0 is S4 but the position thereof is located in the direction opposite to the traveling direction of the vehicle, the offset time is derived as −S4/v and the signal light display start time point of the fourth management-target traffic light ID4 is set to the time point which leads by S4/v from 00:00.

Here, the traveling speed v of a vehicle is not a speed at which the vehicle actually travels, but is a signal light-interlocked speed interlocking with the signal light change of traffic lights so as to make a traffic flow smooth and may have a value in which actually-collected road information such as the number of lanes, gradient, curvature, presence of a speed bump, a state of a road surface, weather, vehicle traffic, queue, and time zone is reflected. The signal light-interlocked speed is different from the concept of section speed information in TPEG.

The traveling speed of a vehicle is a representative speed (for example, the highest movement speed or the speed with a long movement time) in the corresponding road and the difference from the actual speed can be adjusted using a pseudo-distance (phase distance). Here, the pseudo-distance (phase distance) is not an actual distance and the magnitude may be different from the actual distance depending on the road conditions or the like.

For example, in rainy weather, the traveling speed of a vehicle is set to a speed reduced by 10% to 20% from the traveling speed in fine weather and can be used as a parameter for calculating an offset time for determining the signal light display start time points of the management-target traffic lights. In addition, one or more of road information pieces actually collected can be used as a factor for determining the traveling speed. The determination method thereof can be implemented in the form of a linear function, a quadratic function, or a multi-order function with multiple unknowns. Such a method of determining the traveling speed can be determined using statistical results by experiments or measurements, which is obvious to those skilled in the art and thus will not be described in detail.

The above-mentioned road information may be reflected in the distance between the traffic lights instead of the traveling speed. This distance may be referred to as a phase distance. Here, the offset time can be calculated as expressed by Expression 1.

$$T\text{offset}=D/V+E \qquad \text{Expression 1}$$

Here, Toffset represents the offset time, D represents the phase distance, V represents the speed, and E represents the deviation.

When a factor independently operating is present in the factors reflected in the phase distance, the expression for calculating the offset time may be expressed by an expression with multiple unknowns or a polynomial expression with multiple unknowns.

A system enabling the comprehensive traffic light control using the offset time on the basis of the identification information having a layered structure as described above, that is, a traffic light control system according to another embodiment of the present invention has the same configuration as the traffic light control system illustrated in FIG. 1 and will be described below centered on the functional differences.

In the traffic light control system according to the embodiment of the present invention, when the traffic control center broadcasts a broadcast signal including display start control information for causing traffic lights, which are selected at a time by the identification information having a layered structure on the basis of currently-collected road information, to sequentially start displaying of predetermined signal light, the traffic light controllers managing the traffic lights selected at a time by the identification information having a layered structure receive and analyze the broadcast signal, determine signal light display start time points suitable for the traffic lights to be controlled, and control signal light change of the corresponding traffic lights in synchronization with the signal light display start time points. The signal light change with the same display cycle in the relevant traffic lights lags or leads by a predetermined offset time with one command (broadcast) and the traffic lights on the road sequentially change the traffic signal light by interlocking with the traveling speed of a vehicle, thereby making a traffic flow smooth and releasing traffic congestion.

Figure 9A:
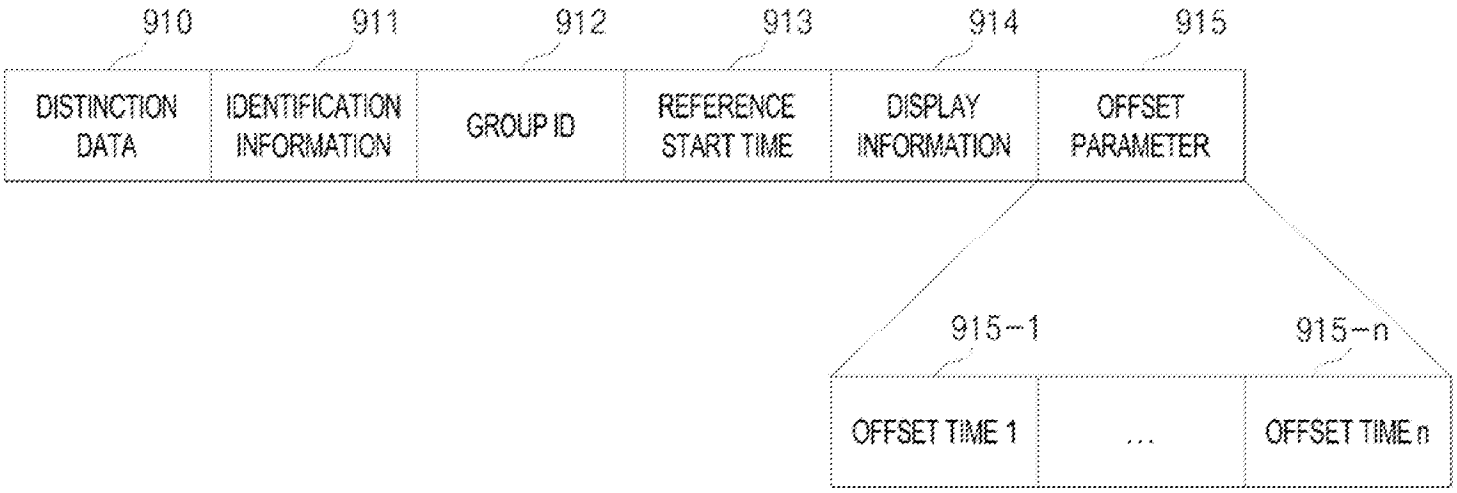
FIG. 9*a* is a diagram illustrating an example of a format of display start control information according to the present invention.

The broadcast signal sent out from the traffic control center 100 has a format illustrated in FIG. 9*a* or 9*b*. FIG. 9*a* is a diagram illustrating an example of a format of the display start control information according to the present invention, and FIG. 9*b* is a diagram illustrating an example of a format of the signal light change control information according to the present invention.

The broadcast signal is configured to include display start control information for controlling the signal light display start time points of the first to n-th traffic light controllers 200 and signal light change control information for controlling signal light change cycles of the first to n-th traffic light controllers 200. In some embodiments, the broadcast signal may further include time synchronization information for synchronizing times of the first to n-th traffic light controllers 200.

That is, as illustrated in FIG. 9*a*, the display start control information includes distinction data 910 for distinguishing information for controlling the display start time point or information for controlling signal light, identification information 911 having a layered structure for determining an area range to be controlled at a time, a group identifier 912 including an ID for identifying the reference traffic light sharing group of which the current display start time point should be adjusted, reference start time data 913 indicating a time point at which signal light display of the reference traffic light is started, display information 914 indicating a signal light change order, signal light change cycles, and the like of the management-target traffic lights, and an offset parameter 915 for calculating the offset times of the management-target traffic lights with respect to the reference traffic light. The offset parameter 915 may include a traveling speed for calculating the offset times on the basis of the currently-collected road information, or the offset times 915-1 to 915-*n* of the management-target traffic lights belonging to the reference traffic light sharing group may be sequentially arranged in a predetermined order. The order in which the offset times of the management-target traffic lights are arranged may be defined in advance, and data on the order (that is, the order in which the offset times are arranged) of the management-target traffic lights in the reference traffic light sharing group may be stored in advance.

An ID of the road may be used as the group identifier 312. In this case, the ordinal number (order) added as an extension to the road ID can be used as a traffic light ID. For example, when the road ID is 100, the IDs of the traffic lights installed in the road may be 101, 102, 103, . . . or 1001, 1002, 1003, . . . . Here, the ordinal numbers may not be relevant to the actual positions, and for example, an installation order or a traveling order may be used.

As illustrated in FIG. 9*b*, the signal light change control information includes distinction data 920 for distinguishing information for controlling the display start time point or information for controlling the signal light, identification information 921 having a layered structure for determining an area range to be controlled at a time, start time data 922 including start time information at which the signal light changing operation is performed, controller identifiers 923 including IDs for identifying the first to n-th traffic fight controllers 200, traffic light number data 924 for distinguishing the traffic lights controlled by the first to n-th traffic light controllers 200, signal light order data 925 including a signal light change order of the traffic lights, and signal light cycle data 926 for holding the changed signal light.

The order in which signal light is changed by the signal light order data 925 includes a variety of displays such as (stop→pass→stop), (stop→pass→left turn→stop), and (stop→left turn→stop→pass→stop) and is repeated with a constant cycle in a ring structure.

In the invention, the display appearing first in the signal light change cycle is referred to as main display, and it is assumed that the main display in all the traffic lights means pass of vehicles. That is, the main display in each management-target traffic light appearing under the signal light change control just after the display start time point is green light indicating pass of vehicles.

As described above, plural traffic lights may be present at a crossroad and an example of a method of identifying the traffic lights is as follows.

0 to 7 as the traffic light numbers are allocated to the traffic lights from north to west via east and south on the basis of the directions toward the intersection of the crossroad, and w is added to the traffic light numbers for pedestrians. The traffic light number may not be allocated to traffic lights which are not located at crossroads but located at crosswalks and may be added to the traffic lights for pedestrians for distinction from the traffic lights for vehicles.

When the directions of north, east, south, and west are set to 0, 90, 180, and 270 degrees, respectively, the relationship between the traffic light numbers and the traffic light directions (expressed in degrees) is as follows.

| <Traffic light number> |
|---|
| 0: 337.5~22.5 |
| 1: 22.5~67.5 |
| 2: 67.5~112.5 |
| 3: 112.5~157.5 |
| 4: 157.5~202.5 |
| 5: 202.5~247.5 |
| 6: 247.5~292.5 |
| 7: 292.5~337.5 |

In this case, the types of signal light are as follows.

| <Type of signal> |
|---|
| 0: not define |
| 1: green light for vehicles |
| 2: green light as left turn for vehicles |
| 3: yellow light for vehicles |
| 4: red light for vehicles |
| 5: green light flickering for vehicles |
| 6: green light flickering as left turn for vehicles |
| 7: yellow light flickering for vehicles |
| 8: red light flickering for vehicles |
| 9: green light for pedestrians |
| 10: red light for pedestrians |
| 11: green light flickering for pedestrians |
| 12: red light flickering for pedestrians |

Here, signal light for pedestrians from 9 to 12 interlocks with the signal light of the corresponding traveling lanes by the use of the same circuit and thus can be omitted.

In this case, an example of crossroad display based on the signal light order data 925 is as follows.

```
<sig_type>
<no>1</no>                                  <-- display type
<offset>45</offset>                         <-- offset time
<tine>          40,40,10,40,40,10,</time>   <-- time of each
                                            displayed signal light
<signal dir="0"> 2, 1, 7, 4, 4, 4</signal>
<signal dir="0w"> 10, 10, 10, 9, 9,11</signal>
<signal dir="4"> 2, 1, 7, 4, 4, 4</signal>
<signal dir="4w"> 10,10, 10, 9, 9,11</signal>
<signal dir="2"> 4, 4, 4, 2, 1, 7</signal>
<signal dir="6"> 4, 4, 4, 2, 1, 7</signal>
<signal dir="2w"> 10, 10, 10, 9, 9,11</signal>
<signal dir="6w"> 10, 10, 10, 9, 9,11<signal>
</sig_type>
```

While the display command has an XML format, the scope of the present invention is not limited to this example and the display command may have a frame structure or may not be associated with the positive order of data.

For example, <act cmd> as a control command can be classified into "copy", "edit", and "delete". The control command "copy" means to newly write the entire data or to update details of the data, the control command "delete" means to delete the corresponding data (such as the display type, the table number, and the signal light), and "edit" means to replace a pan of the details. For example, when there is no detail between comma and comma, the original data is maintained without any change.

mation and the signal light changes of the traffic lights is controlled to interlock with each other under the same time reference.

When the first to n-th traffic light controllers 200 include a GPS unit (not illustrated), the timepieces of the traffic light controllers can be synchronized using GPS time data included in a GPS signal. In this case, the time synchronization information can be omitted from the broadcast signal. The timepiece synchronization using a GPS signal is obvious to those skilled in the art and thus detailed description thereof will not be made.

In order to control the signal light change of management-target traffic lights under the control of the traffic light control system according to another embodiment of the present invention, a traffic light control unit of a traffic light controller analyzes the broadcast signal received by the broadcast signal receiving unit and determines offset times with respect to a reference traffic light in the reference traffic light sharing group to which the management-target traffic lights belong on the basis of the analysis result. The signal light display start time points of the management-target traffic lights are determined so that the signal light display of the management-target traffic lights is started at time points which lags by the determined offset times from the reference start time which is the signal light display start time point of the reference traffic light, and a control signal for controlling the signal light

```
<act cmd="copy">
<id level="1">1</id><run_time>134</run_time><sig_type>1</sig_type>   <-- example previously defined
<id level="1">2</id><run_time>134</run_time><sig_type>1</sig_type>   <-- example previously defined
<id level="1">3</id><run_time>134</run_time><sig_type>               <-- example not previously defined
            <no>4</no>                          <-- display type
            <offset>45</offset>                 <-- offset time
            <time> 50,40,10,40,40,10</time>     <-- time of each displayed signal light
            <signal dir="0"> 2, 1, 7, 4, 4, 4</signal>
            <signal dir="0w"> 10, 10, 10, 9, 9,11</signal>
            <signal dir="4"> 2, 1, 7, 4, 4, 4</signal>
            <signal dir="4w"> 10,10, 10, 9, 9,11</signal>
            <signal dir="2"> 4, 4, 4, 2, 1, 7</signal>
            <signal dir="6"> 4, 4, 4, 2, 1, 7</signal>
            <signal dir="2w"> 10, 10, 10, 9, 9,11</signal>
            <signal dir="6w"> 10, 10, 10, 9, 9,11<signal>
            </sig_type>
<act>
```

According to the illustrated signal, the previously-defined signal change type (sig_type) is 1 when the layer code (level) is 1 and the detailed code (no) is 1 or 2, and the type of display, the offset time, the time of signal light display, the signal change type, and the like can be individually determined when the detailed code (no) is 3 and the type is not previously defined.

Alternatively, the broadcast signal may be time synchronization information including time data, which is information for synchronizing the times of the first to n-th traffic light controllers 200 to remove time errors among the first to n-th traffic light controllers 200, as a control command. Here, the time synchronization information is transmitted for each predetermined cycle to reset the timepieces installed in the first to n-th traffic light controllers 200, and the time data provides a current time in the units of seconds in a range of 00000 to 86400 (224 hours×60 minutes×60 seconds) in a day.

For example, the time synchronization information may be expressed in the units of seconds in the time range of a week.

The timepieces of the first to n-th traffic light controllers 200 can be synchronized by the time synchronization inforchange of the management-target traffic lights is output. Here, when the offset time has a negative value, the time point which leads by the absolute value of the offset time is the signal light display start time point of the corresponding management-target traffic light.

The traffic light control unit will be described below in detail with reference to FIG. 10.

Figure 10:
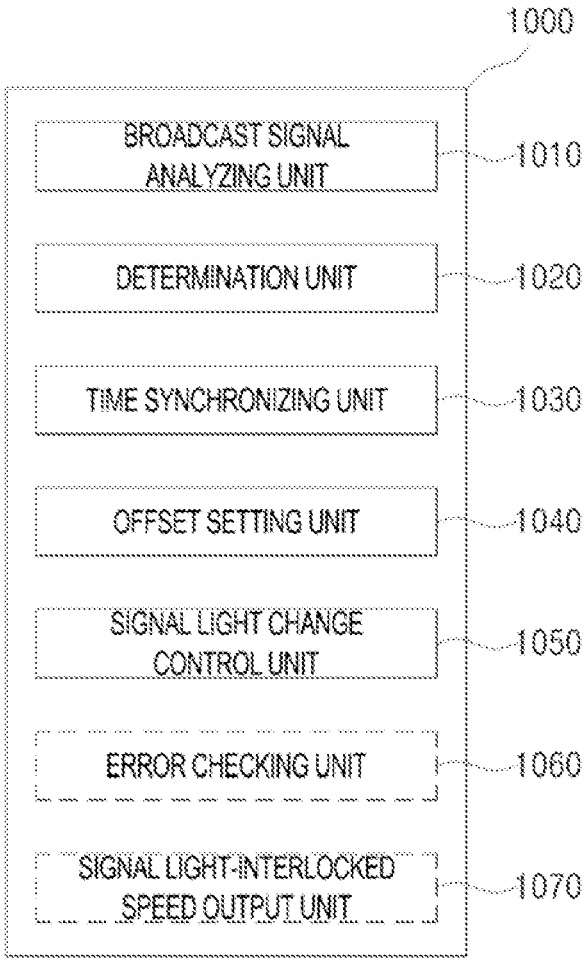
FIG. 10 is a block diagram illustrating a configuration of a traffic light control unit according to another embodiment of the present invention.

FIG. 10 is a block diagram illustrating a configuration of a traffic light control unit according to the embodiment of the present invention. Referring to FIG. 10, the traffic light control unit 1000 includes a broadcast signal analyzing unit 1010, a determination unit 1020, a time synchronizing unit 1030, an offset setting unit 1040, and a signal light change control unit 1050. In some embodiments, the traffic light control unit may further include an error checking unit 10600 and/or a signal light-interlocked speed output unit 1070. One or more elements of the traffic light control unit may be embodied in the form of one or more of an algorithm implemented by a combination of program codes and a software program.

Here, the broadcast signal analyzing unit 1010, the determination unit 1020, and the error checking unit 1060 have the same functions as the broadcast signal analyzing unit 510, the determination unit 520, and the error checking unit 540 of the traffic light control unit 220 illustrated in FIG. 5, respectively, and differences therebetween will be mainly described below. The time synchronizing unit 1030, the offset setting unit 1040, and the signal light change control unit 1050 correspond to the control command executing unit 530 of the traffic light control unit 220 illustrated in FIG. 5 and the functions thereof will be described below in detail.

The broadcast signal analyzing unit 1010 analyzes the broadcast signal received by the broadcast signal receiving unit 210 and extracts an offset parameter suitable for the management-target traffic light, signal light control data, time data, and the like from the broadcast signal. The format of the broadcast signal is the same as described with reference to FIG. 9.

The determination unit 1020 determines whether a management-target traffic light belongs to a target of a control command using the identification information having a layered structure extracted as the analysis result of the broadcast signal. Only when it is determined that the management-target traffic light belongs to the target of the control command, the constituent units such as the time synchronizing unit 1030, the offset setting unit 1040, and the signal light change control unit 1050 corresponding to the control command executing unit may be activated to perform the operations to be described later.

Before determining the offset times, the management-target traffic lights belonging to a reference traffic light sharing group need to have the same system time. In order to synchronize the system times, the traffic light control unit 1000 includes the time synchronizing unit 1030.

When the traffic light control unit 200 includes a GPS unit, the time synchronizing unit 1030 may synchronize the system times on the basis of a GPS signal received from a satellite via the GPS unit so as not to cause a time difference between the reference traffic light and the other management-target traffic lights belonging to the same reference traffic light sharing group.

Alternatively, when the broadcast signal analyzing unit 1010 extracts the time data as the broadcast signal analysis result, the time synchronizing unit 1030 can reset the previous system time and set the current system time to the time corresponding to the time data so as to remove the time errors between the reference traffic light and the other management-target traffic lights belonging to the same reference traffic light sharing group.

The offset setting unit 1040 sets the offset times of the management-target traffic lights using the offset parameter extracted by the broadcast signal analyzing unit 1010.

When the extracted offset parameter is data on the traveling speed on the road, the offset setting unit 1040 reads the previously-stored distances between the reference traffic light and the management-target traffic lights from a memory (not illustrated), applies the traveling speed and the distances to a predetermined algorithm, and sets the calculated values as the offset times of the management-target traffic lights. For example, a ratio of the distance and the traveling speed may be set as the offset time. As described above, the traveling speed may be a value in which one or more road information pieces of the current traveling speed of a vehicle traveling on the road, the number of lanes of the road, the gradient, the curvature, presence of a speed bump, a state of the road surface, the weather, the vehicle traffic, the queue, and the time zone are reflected.

When the extracted offset parameter is data in which plural offset times are sequentially arranged in a predetermined order, the offset setting unit 1040 may extract the offset time corresponding to the order of the corresponding management-target traffic light on the basis of a predetermined order of the management-target traffic lights in the reference traffic light sharing group and may set the extracted offset time as the offset time of the management-target traffic light. In this case, information on the distances between the reference traffic light and all the management-target traffic lights belonging to the same reference traffic light sharing group is stored in the traffic control center 100, and values obtained by dividing the distances by the traveling speed reflecting the currently-collected road information are calculated as the offset times of the management-target traffic lights in advance, may be included in the broadcast signal, and may be broadcast.

The signal light change control unit 1050 sets the signal light display start time point of the management-target traffic light to the time point which lags by the offset time set by the offset setting unit 1040 from the reference start time of the reference traffic light based on the system time set by the time synchronizing unit 1030, and outputs to the management-target traffic light a control signal for causing the management-target traffic light to periodically change the signal light, that is, to start the main display, at the set signal light display start time point.

When the offset time set by the offset setting unit 1040 has a negative value, it means that the management-target traffic light is installed prior to the reference traffic light. In this case, the time point which leads by the time corresponding to the absolute value of the offset time from the reference tart time is set as the signal light display start time of the management-target traffic light.

When the broadcast signal is the signal light change control information as the analysis result in the broadcast signal analyzing unit 1010, the signal light change control unit 1050 extracts and compares the controller identifier, and extracts the start time data, the traffic light number data, the signal light order data, and the signal light cycle data and updates the display table of the management-target traffic light when the extracted controller identifier corresponds to the traffic light controller. That is, the signal light change control unit can output to the management-target traffic light a control signal for causing the traffic light (traffic light for vehicles and/or pedestrians) corresponding to the traffic light number data out of the management-target traffic lights to change the signal light repeatedly with a signal light cycle corresponding to the signal light cycle data at the time point corresponding to the start time data in the signal light change order based on the signal light order data.

When existing signal light display is periodically carried out and should be changed to new signal light display by receiving the broadcast signal, the signal light change control unit 1050 calculates a time difference between the existing signal light display and the new signal light display, calculates the number of display occurrence in the time difference, and synchronizes the time so that the new signal light display is started at a desired time point by increasing or decreasing the display time. In this case, only a specific display time may be changed or the entire display time may be increased or decreased at a uniform rate.

The traffic light controller 200 may further include a signal light-interlocked speed output unit 1070. The signal light-interlocked speed output unit 1070 outputs traveling speed information included in the offset parameter extracted as the analysis result of the broadcast signal or information on the traveling speed inversely calculated from the offset time included in the offset parameter using the distance between the reference traffic light and the management-target traffic light in the form of characters, signs, voice, or graphics so as that the driver on the road can confirm the information. For example, an LCD or LED display unit may be disposed around the traffic light and the signal light-interlocked speed may be displayed in the form of characters, signs, or graphics, or a speaker may be disposed around the traffic light and the signal light-interlocked speed may be output as voice information.

The signal light-interlocked speed output unit 1070 may transmit the signal light-interlocked speed information by communicating with a communication terminal (for example, a navigation terminal) mounted on a vehicle traveling on the road in a short-range radio communication manner, and may cause the driver to confirm the corresponding information through the use of an output module (such as a display unit or a speaker) disposed in the communication terminal inside the vehicle.

In the present invention, the signal light-interlocked speed for making a traffic flow on the road smooth is assumed and the traffic lights sequentially change the signal light thereof. Therefore, when a driver traveling on the road is provided with the signal light-interlocked speed interlocking with the current signal light change, an overspeed can be prevented to achieve safe driving and the driver does not wait at the traffic lights, which is helpful to economical driving.

Alternatively, since information on the signal light-interlocked speed is registered in the traffic control center 100, information on the signal light-interlocked speed on the road corresponding to the vehicle position information may be broadcast from the traffic control center 100 to the corresponding vehicle via a broadcast network.

The communication terminal (for example, a navigation terminal) mounted on a vehicle extracts the information on the signal light-interlocked speed included in the received broadcast signal, converts the extracted information into the form which can be confirmed by the driver, and outputs the resultant information. For example, the information may be displayed in the form of characters or numerals in a partial area of a screen display unit or may be output in the form of voice from the speaker.

The signal light-interlocked speed may be used as information for a cruise function of enabling constant-speed traveling without stepping the vehicle accelerator by interlocking with a device (for example, an ECU) of the vehicle.

In the traffic light controller 200 according to the present invention, a display table for signal light change may be basically stored in a memory thereof. One or more display tables may be provided, may vary depending on conditions such as weather, rush hour, time zone, weekday, holiday, and knight, may be combined for use. Even when the type and order of signal light display is the same, the holding time of signal light display may be changed depending on the conditions. The display table may include such a form that the traffic lights in all directions or the traffic lights in some directions flicker when an accident occurs on the road or the road is closed. Alternatively, when the broadcast signal is not received for a predetermined time due to occurrence of disaster, the disaster state may be checked and predetermined signal light display such as flickering of yellow light may occur.

The display table may be updated such as being edited, deleted, or added. The update of the display table may be carried out on the basis of the signal light change control information when the signal light change control information is included in the broadcast signal as the analysis result of the broadcast signal.

Figure 11:
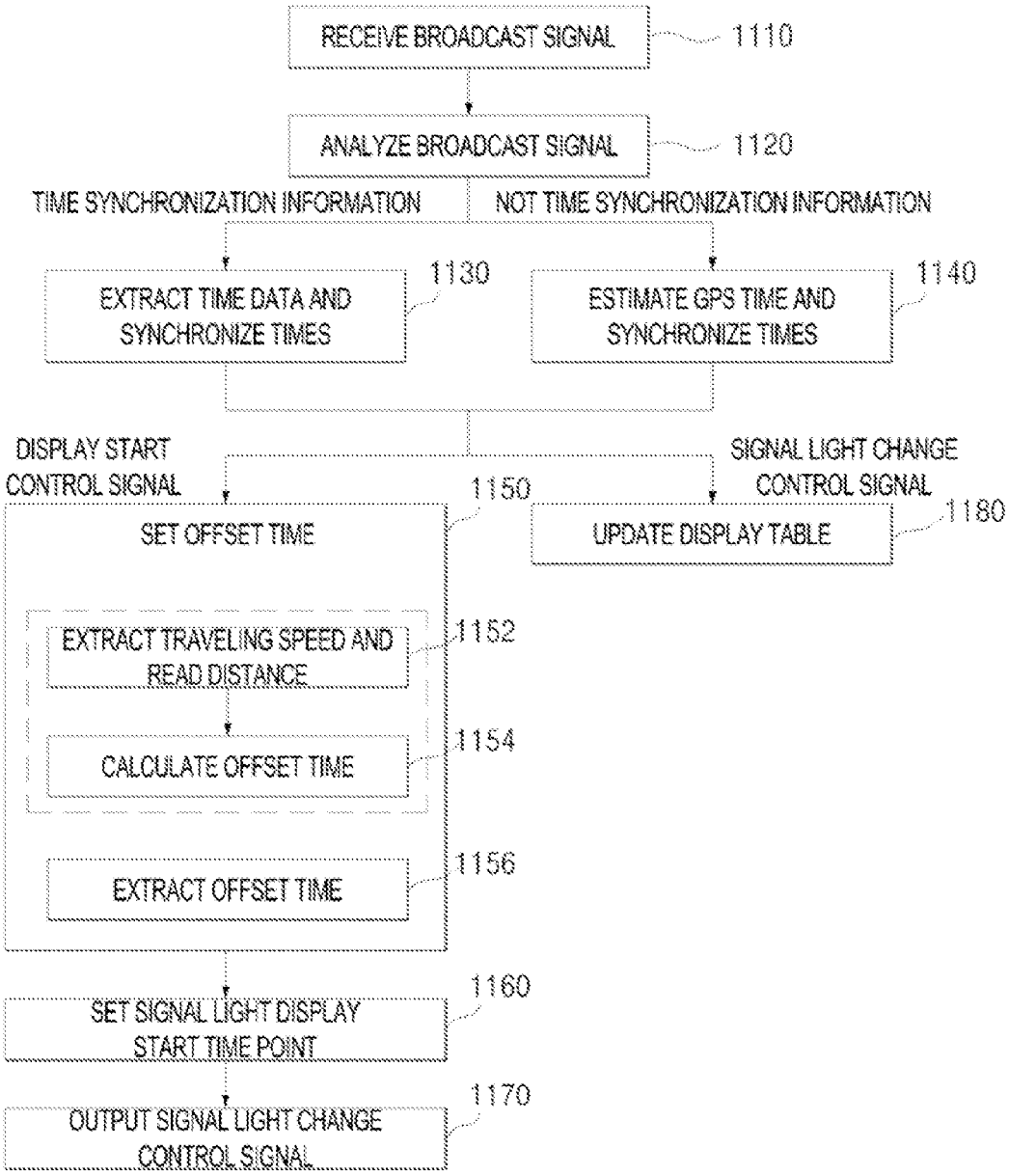
FIG. 11 is a flowchart illustrating a traffic light control method according to another embodiment of the present invention.

FIG. 11 is a flowchart illustrating a traffic light control method according to another embodiment of the present invention.

The process flow illustrated in FIG. 11 is performed by the constituent units of the traffic light controller and is based on the method of controlling signal light change of a management-target traffic light when a broadcast signal is received via a broadcast network.

Referring to FIG. 11, the broadcast signal receiving unit receives a broadcast signal emitted from the traffic control center 100 via the broadcast network in step 1110. The broadcast signal may be received via a broadcast channel such as FM, AM, DMB, DAB, DVB-T, DVB-H, or MFLO.

In step 1120, the broadcast signal analyzing unit 410 analyzes the broadcast signal received by the broadcast signal receiving unit 210. The broadcast signal includes distinction data as illustrated in FIGS. 9*a* and 9*b*, and can be determined to be which of display start control information, signal light change control information, and time synchronization information depending on the extraction and analysis result of the distinction data.

The process of analyzing the broadcast signal includes a process of extracting data (such as a group identifier, reference start time data, offset parameter, start time data, traffic light number data, signal light order data, signal light cycle data, and time data) other than the distinction data included in the broadcast signal.

The determination process of steps 610 to 630 may be performed in the process of analyzing the broadcast signal, and the subsequent steps may be performed only when the corresponding management-target traffic light belongs to the target of the control command as the determination result. When the corresponding management-target traffic light does not belong to the target of the control command, the existing signal light change system can be maintained and the steps to be described below will not be performed.

When it is determined that the management-target traffic light belongs to the target of the control command, the process of step 1130 and the steps subsequent thereto are performed and details thereof are as follows.

When the broadcast signal is the time synchronization information as the analysis result in the broadcast signal analyzing unit 1010, the time synchronizing unit 1030 synchronizes the system time of the traffic light controller 200 with the system times of the reference traffic light and other traffic light controllers using the time data extracted from the broadcast signal in step 1130.

When the broadcast signal is not the time synchronization information as the analysis result in the broadcast signal analyzing unit 1010, the time synchronizing unit 420 estimates the GPS time using the GPS unit separately included in the traffic light controller 200 and synchronizes the system time of the traffic light controller with the estimated GPS time to synchronize the reference traffic light with the other traffic light controllers in step 1140.

When the time synchronization is completed and the broadcast signal is the display start control information, the offset setting unit 1040 sets the offset times of the management-target traffic lights using the offset parameter extracted by the broadcast signal analyzing unit 1010 in step 1150.

When the extracted offset parameter is data on the traveling speed on the road, the offset setting unit 1040 reads the distances between the reference traffic light and the management-target traffic lights stored in advance in step 1152, and applies the traveling speed and the distances to a predetermined algorithm to calculate the offset times of the management-target traffic lights in step 1154.

When the extracted offset parameter is data in which plural offset times are sequentially arranged in a predetermined order, the offset setting unit 1040 extracts the offset timed corresponding to a predetermined order of the management-target traffic signals in the reference traffic light sharing group and sets the extracted offset times as the offset times of the management-target traffic lights in step 1156.

When the setting of the offset times is completed, the signal light change control unit 1050 sets the signal light display start time points of the management-target traffic lights to the time points which lag by the offset times from the reference start time of the reference traffic light based on the system time set by the time synchronizing unit 1030 in step 1160.

In step 1170, the signal light change control unit 1050 outputs a control signal for causing the management-target traffic lights to start main display of signal light at the newly-set signal light display start time point to the management-target traffic lights. Here, the main display may be display of signal light (for example, green light) which causes vehicles traveling in a predetermined direction to go ahead.

When the broadcast signal is the signal light change control information, the signal light change control unit 1050 extracts the start time data, the traffic light number data, the signal light order data, and the signal light cycle data for the corresponding controller identifier and updates the display table of the management-target traffic lights in step 1180.

The above-mentioned traffic light control method may be embodied as automated procedures based on the time-series order by a program built or installed in a digital processor. Codes and code segments of the program will be easily inferred by computer programmers skilled in the art. The program can be stored in a computer-readable recording medium and can be read and executed by a digital processor to embody the above-mentioned method. The recording medium includes a magnetic recording medium, an optical recording medium, and a carrier wave medium.

The concept of a virtual traffic light is introduced into the present invention. Accordingly, an ID of a traffic light controller can be allocated to a location in which a traffic light is not actually installed and the signal light change cycle of the virtual traffic light can be transmitted by broadcasting.

In this case, a vehicle traveling around the location can receive the broadcast signal through the use of a navigation terminal or the like, can understand signal light of the traffic lights in the traveling direction, and can use the virtual traffic lights as the actual traffic lights at the time of guiding a path. The signal light may be displayed on a display unit or output as an audio via a speaker so as to enable a user to recognize the signal light.

A device receiving the broadcast signal like a navigation terminal installed in a vehicle can display signal light change cycles and states of the traffic lights at crossroads and can visually or auditorily inform the next time of change to signal light indicating that a vehicle can go ahead. Alternatively, the device can perform an operation of stopping an engine in a waiting state and automatically starting up when the signal light indicating that a vehicle can go ahead appears in the next time. The broadcast signal can be used as a signal for controlling the operation of an engine in economical driving. That is, such a signal may be used to notify the remaining time up to the next signal light for going ahead or the next signal light cycle or the entire order, or may be used as a vehicle control signal for stopping or slowing down the vehicle when the signal light received from the traffic light installed in the traveling direction is red.

In the present invention, the identification information having a layered structure may be constructed by dividing an area into sub areas with a constant size using longitude and latitude information. The identification information having a layered structure may be constructed using aspects other than this geographical aspect.

For example, the identification information (that is, road link IDs and/or traffic light IDs) may be classified to have a layered structure based on an emergency evacuation system for disaster or may be classified to have different identification information pieces in morning and evening rush hours. In this case, one traffic light controller may have different identification information pieces (IDs) based on different classification methods and may received and process a control command based on a classification method other than the current classification method for the signal light change control if necessary. In this case, particular identifiers may be necessary for the classification methods.

The road section selected in a batch manner by the identification information having a layered structure included in the broadcast signal does not need to include only a straight line, and may be a section formed by connecting road links corresponding to the shortest path from a start location to a destination location. For example, in order to connect the road links corresponding to the shortest path from an accident site to a hospital when an ambulance runs in emergency, left turns or right turns may be included in addition to the straight traveling.

In addition, identification information (ID) corresponding to different classification methods may be shared. The above-mentioned classification method for guiding an ambulance to the shortest path will be usefully used only in the vicinity of a hospital and will not be useful in a location spaced apart by a predetermined distance from the hospital. Therefore, the offset times may be adjusted so as to guide the shortest path based on the classification method for emergency rescue to an ambulance in the vicinity of a hospital, and the offset times may be adjusted so as to cause the signal light change to interlock with each other on the basis of a normal classification method in a location spaced apart from the hospital. For example, even in the normal classification method, it is possible to adjust the offset times by adjusting the display start time points.

The entire area taken charge of by a traffic control center may be divided using together a classification method in the X axis direction (for example, east-west direction) and a classification method in the Y axis direction (for example, south-north direction) and the present invention may be applied thereto. Identification information based on the X-axis classification method and the Y-axis classification method and other information necessary for the signal light change control may be defined in each traffic light controller or may be received from the traffic control center.

For example, at the time of traffic congestion, the traffic flows in the X axis direction and the Y axis direction can be made to be smooth by optimizing the traffic lights of roads in one direction (one of the X axis direction and the Y axis direction) and causing the display start times of other roads to lead or lag with respect to the road having the largest traffic in the other direction (the other of the X axis direction and the Y axis direction).

When the signal light change is optimized to make the traffic flow in the X axis direction smooth, the leading or lagging of the display start time points as a whole may not cause any problem.

When the offset times in the Y axis direction is calculated so as to optimize the traffic flow in the road having the largest traffic or the largest congestion in the Y axis direction and the display start time points in the X axis direction appropriately lead or lag so as not to hinder the traffic flow in the X axis direction, it is possible to cause vehicles to smoothly travel in the roads in the X axis direction and in the roads in the Y axis direction.

Those skilled in the art will understand that the invention can be modified in various specific forms without changing the technical concept or essential features of the invention. Accordingly, it should be understood that the above-mentioned embodiments are not definitive but exemplary in all the points of view. The scope of the invention is defined by the appended claims, not by the above-mentioned detailed description, and it should be understood that all modifications and changes derived from the scope of the claims and equivalents thereof belong to the scope of the invention.

The invention claimed is:

1. A traffic light control device that controls signal light change of a management-target traffic light, comprising:

a broadcast signal receiving unit that receives a broadcast signal emitted from a traffic control center via a broadcast network, wherein the broadcast signal includes identification information having a layered structure and a control command; and a traffic light control unit that determines whether the management-target traffic light belongs to a target of the control command on the basis of the identification information having a layered structure and that outputs the control signal for performing the signal light change based on the control command only when the management-target traffic light belongs to the target of the control command.

2. The traffic light control device according to claim 1, wherein when an entire area taken charge of by the traffic control center is divided into sub areas corresponding to a plurality of exclusive layers in which traffic lights are installed, the identification information having a layered structure is information for identifying one or more sub areas on which batch signal light change based on the control command will be performed.

3. The traffic light control device according to claim 2, wherein the identification information having a layered structure has a structure in which a bit number of data increases with a shift to a lower layer.

4. The traffic light control device according to claim 3, wherein layer information for distinguishing layers of sub areas which are the target of the control command is extracted from the bit number of the identification information having a layered structure.

5. The traffic light control device according to claim 2, wherein the identification information having a layered structure includes a layer code indicating the layer of a sub area which is the target of the control command and a detailed code for distinguishing the sub area from the other sub areas in the same layer.

6. The traffic light control device according to claim 2, wherein the identification information having a layered structure includes a street code corresponding to a street address or a postal code corresponding to a lot number address.

7. The traffic light control device according to claim 1, wherein the traffic light control unit includes:

a broadcast signal analyzing unit that analyzes the broadcast signal;

a time synchronizing unit that synchronizes a system time of the management-target traffic light with a system time of a reference traffic light using time-synchronization time data extracted from the broadcast signal or a GPS time estimated through the use of a GPS unit;

an offset setting unit that sets an offset time using an offset parameter extracted from the broadcast signal; and a signal light change control unit that outputs a control signal for starting signal light display of the management-target traffic light at a time point which lags by the offset time from a signal light display start time point of the reference traffic light.

8. A traffic light control method which is performed by a traffic light control device that controls signal light change of a management-target traffic light, comprising the steps of:

receiving a broadcast signal emitted from a traffic control center via a broadcast network, wherein the broadcast signal includes identification information having a layered structure and a control command;

analyzing the broadcast signal and extracting layer information of the identification information having a layered structure;

extracting distinction data corresponding to the layer information from the identification information of the management-target traffic signal;

comparing the distinction data with the identification information of the broadcast signal and determining whether the management-target traffic light belongs to a target of the control command; and performing signal light change based on the control command when it is determined that the management-target traffic light belongs to the target of the control command.

9. The traffic light control method according to claim 8, wherein when an entire area taken charge of by the traffic control center is divided into sub areas corresponding to a plurality of exclusive layers in which traffic lights are installed, the identification information having a layered structure is information for identifying one or more sub areas on which batch signal light change based on the control command will be performed.

10. The traffic light control method according to claim 9, wherein the identification information having a layered structure has a structure in which a bit number of data increases with a shift to a lower layer.

11. The traffic light control method according to claim 10, wherein the layer information for distinguishing layers of sub areas which are the target of the control command is extracted from the bit number of the identification information having a layered structure.

12. The traffic light control method according to claim 11, wherein upper bit data corresponding to the bit number corresponding to the layer information in the identification information of the management-target traffic light is extracted from the distinction data.

13. The traffic light control method according to claim 9, wherein the identification information having a layered structure includes a layer code indicating the layer of a sub area which is the target of the control command and a detailed code for distinguishing the sub area from the other sub areas in the same layer.

14. The traffic light control method according to claim 13, wherein an identification code having the same layer code as the layer code in the identification information of the management-target traffic light is extracted as the distinction data.

15. The traffic light control method according to claim 9, wherein the identification information having a layered structure includes a street code corresponding to a street address or a postal code corresponding to a lot number address.

16. The traffic light control method according to claim 8, wherein the step of performing signal light change based on the control command includes the steps of:

determining an offset time from a reference traffic light on the basis of an analysis result of the broadcast signal; and outputting the control signal for controlling the signal light change of the management-target traffic light so that a time point which lags by the offset time from a reference time is matched with a signal light display start time point of the management-target traffic light.

* * * * *